US006039457A

United States Patent [19]

O'Neal

[11] Patent Number: 6,039,457

[45] Date of Patent: Mar. 21, 2000

[54] LIGHT BRACKET

[75] Inventor: Timothy L. O'Neal, Hillsboro, Oreg.

[73] Assignee: Intex Exhibits International, L.L.C., Beaverton, Oreg.

[21] Appl. No.: 08/992,685

[22] Filed: Dec. 17, 1997

[51] Int. Cl.[7] ..... G09F 13/00; F21S 3/00

[52] U.S. Cl. ..... 362/217; 362/285; 362/287; 362/418; 362/427; 362/812

[58] Field of Search ..... 362/217, 285, 362/287, 418, 427, 812, 225, 260; 40/558, 541

[56] References Cited

U.S. PATENT DOCUMENTS

| | | | |
|---|---|---|---|
| 1,701,710 | 2/1929 | Turner et al. . | |
| 2,800,573 | 7/1957 | Hudson . | |
| 2,858,629 | 11/1958 | Carter . | |
| 3,108,751 | 10/1963 | Rodmaker et al. | 362/427 |
| 4,118,766 | 10/1978 | Kredo | 362/427 |
| 4,658,337 | 4/1987 | Burke . | |
| 4,782,428 | 11/1988 | Lowell et al. . | |
| 4,926,294 | 5/1990 | Beaulieu et al. . | |
| 4,994,943 | 2/1991 | Aspenwall | 362/219 |
| 5,600,909 | 2/1997 | Hooper . | |
| 5,733,032 | 3/1998 | Bolta | 362/97 |
| 5,825,637 | 10/1998 | Chen | 362/417 |

*Primary Examiner*—Thomas M. Sember
*Attorney, Agent, or Firm*—Kolisch Hartwell Dickinson McCormack & Heuser

[57] ABSTRACT

A light bracket for mounting and supporting a light adjacent to a surface. Typically, the light bracket includes an elongate member configured to support the light and a first and a second locking arm, pivotally mounted at opposite ends of the elongate member. Typically, each of the arms includes an open position extending substantially perpendicular to the elongate member such that each of the arms is configured to mount to the surface and support the elongate member a distance from the surface. In addition, each of the arms typically is pivotable to a closed position extending substantially parallel to the elongate member such that a space is defined for the light between each of the arms and the elongate member.

32 Claims, 3 Drawing Sheets

LIGHT BRACKET

BACKGROUND OF THE INVENTION

This invention relates generally to lighting devices, and more particularly to a bracket for removably mounting a light to a display.

Several qualities are desirable in light brackets used to removably mount a light to a surface. A removable light bracket should easily attach and detach from the surface to which it mounts. When attached, the light bracket should remain securely mounted, and should support the light in a fixed position and orientation in relation to the surface. When detached, the light bracket should become compact, so as to facilitate transport and storage. In the event that a light bulb breaks or bums out, a light bracket should allow the user to quickly and easily change bulbs.

Several additional qualities are desirable when a light bracket is used to removably mount a light to a portable exhibit. A light bracket used with a portable exhibit should be portable. An exhibit is often moved from location to location by persons unfamiliar with its manner of assembly. Therefore, it is desirable that a light bracket used with an exhibit be easy to disassemble, pack, transport, unpack, and reassemble without loss or breakage.

During disassembly, a single person, without the aid of a step stool or an instruction manual, should be able to detach the light bracket from the exhibit. During packing, it is desirable that the light bracket fold down to as compact a form as possible, and shield any fragile or sharp surfaces. During storage, it is desirable that the light bracket be able to stack in any orientation, boxed or unboxed. During unpacking it is desirable that the light bracket afford the user an area to grasp, away from fragile or sharp surfaces, to remove the device from its packaging. During assembly, it is desirable that the device be symmetrical, so that it is impossible to mount the device in an incorrect orientation.

When a light bracket is used with an exhibit, it is desirable that the light bracket attach directly to the exhibit to save shipping costs and set up time that an external support device might require. To increase usable area inside the exhibit and to avoid unwanted collisions between exhibit goers and lighting devices, it is desirable that a light bracket mount on an outside wall, overhead, or in some other location inaccessible to exhibit goers.

Several additional qualities are highly desirable when a light bracket is used to illuminate a display. A light bracket for a display desirably positions the light source to adequately illuminate the display. Adequate illumination of a display often requires that light be evenly distributed to the edges of the display and bright enough to make the display visible even in moderate ambient light. Further, a light bracket should be adjustable to support lights which illuminate displays of different sizes and shapes.

Several additional qualities are highly desirable when a light bracket is used to backlight a display on a portable exhibit. The light bracket should position the light on the opposite side of the display from the viewer, so that the light shines in the direction of the back side of the display. The light should be diffuse so as not to cast any sharp shadow on the display in the event that an object comes between the light and the display. To minimize the space occupied by the display, it is also desirable that the light bracket be able to illuminate a display that is flush with the edges of the exhibit.

Several problems exist with current removable light brackets. Many do not fold down, making them difficult to transport and store. Another problem with current removable light brackets is that they often do not protect their bulbs during shipping. Broken bulbs increase costs and frustrate exhibit owners. Lack of available replacement bulbs can result in an incomplete presentation and loss of business.

Several additional problems exist with current removable light brackets tailored to backlight displays in portable exhibits. One problem is that these light brackets often attach to a freestanding support structure. It is desirable for a removable light bracket to utilize the exhibit frame for support. Because of the external support structure, current light brackets are often heavy and unable to fold down for storage.

Another problem with these light brackets is that often they only provide support for point-sources of light, providing uneven illumination. Uneven illumination makes displays difficult to read and less effective in catching the eye of the customer.

Yet another problem with these light brackets is that they often cannot support a light to backlight a panel that is flush with an interior wall of the exhibit. Many current light brackets resemble lightboxes, such as those used to view X-rays and slides. This type of device protrudes when hung from an exhibit wall.

It is the object of the present invention to create a removable light bracket that provides support to a light which evenly illuminates a surface. It is a further goal of the present invention to create a light bracket that is quick and easy to assemble and disassemble, and which folds down to protect its light bulbs and become compact for storage.

It is another object of the present invention to create an expandable light bracket that is able to mount to other units so that it can illuminate panels of varying sizes and shapes.

These and other objects and advantages of the present invention will become more fully apparent as the description which follows is read in conjunction with the drawings.

SUMMARY OF THE INVENTION

The present invention typically is in the form of a light bracket for mounting and supporting a light adjacent to a surface including the following components: (1) an elongate member configured to support the light; (2) a first and a second locking arm, pivotally mounted at opposite ends of the elongate member, each of the arms having an open position extending substantially perpendicular to the elongate member such that each of the arms is configured to mount to the surface and support the elongate member a distance from the surface, and each of the arms being pivotable to a closed position extending substantially parallel to the elongate member such that a space is defined for the light between each of the arms and the elongate member.

DETAILED DESCRIPTION OF THE PREFERRED EMBODIMENTS

Reference should now be made to FIGS. 1–5, which depict a preferred embodiment of the present invention. Light bracket 10 is symmetrical in two dimensions, so that the right side of the device mirrors the left and the bottom of the device mirrors the top. Additional views showing these other sides are not shown for the sake of brevity.

Figure 1:
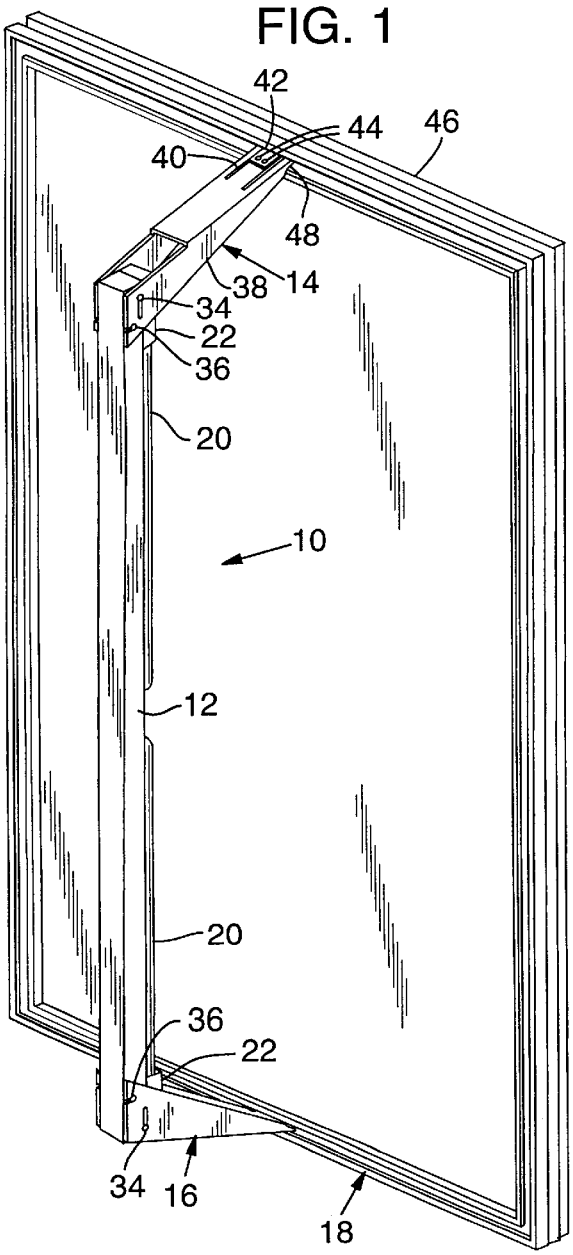
FIG. 1 is a perspective view from the top back left of the exterior of a preferred embodiment of the present invention in an open position mounted to a display.

As shown in FIG. 1, light bracket 10 includes an elongate member 12 and identical locking arms 14, 16 hinged at opposite ends of elongate member 12. In a first, open position, locking arms 14, 16 mount to display 18 so that lights 20 mounted in fixtures 22 along the length of elongate member 12 illuminate display 18. In a second, closed position, shown in FIG. 5, locking arms 14, 16 are substantially parallel to elongate member 12 to cover and protect lights 20.

Figure 2:
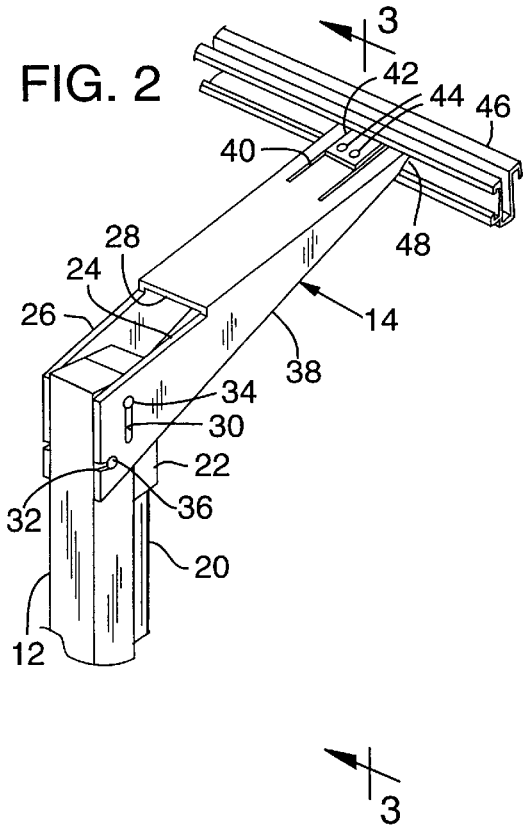
FIG. 2 is a detailed perspective view from the top back left of the embodiment of FIG. 1 showing the first locking arm hinged to the elongate member.

As shown in FIG. 2, locking arm 14 includes a pair of identical parallel panels 24, 26 connected by a bridging panel 28. Panel 24 is triangular in shape in the depicted embodiment, and includes an internal slot 30 that runs parallel to a proximate edge of panel 24 and a notch 32 that extends into panel 24 from the proximate edge. A first pin 34 extends through slot 30 and attaches to elongate member 12, thereby forming a pin and slot hinge and hinging the locking arm 14 to elongate member 12. A shaft 34*a* (see FIGS. 3–5) of the first pin 34 is slightly smaller than the width of slot 30, allowing the first pin 34 to slide freely within slot 30. A cap 34*b* of the first pin 34 is slightly larger than the width of slot 30 to prevent the first pin 34 from inadvertently dislodging from slot 30 and keeping panel 24 securely hinged to elongate member 12. Slot 30 includes a top end 30*a* and a bottom end 30*b*. In an alternative embodiment which is not depicted, slot 30 may also include an oversized hole of a diameter larger than cap 34*b*, so that locking arm 14 may be removed from the elongate member 12 when the oversized hole is positioned around the cap 34*b* and the panels 24, 26 are biased away from the elongate member.

A second pin 36 is attached to elongate member 12 at a distance toward the center of elongate member 12 from the first pin 34. While a variety of dimensions may be utilized, in the preferred embodiment the first pin is longitudinally displaced 5 cm and transversely displaced 0.75 cm along elongate member 12 from the second pin. The second pin alternately engages notch 32 or stop 38 of panel 24 when the locking arm 14 is in the open position or closed position, respectively.

Figure 3:
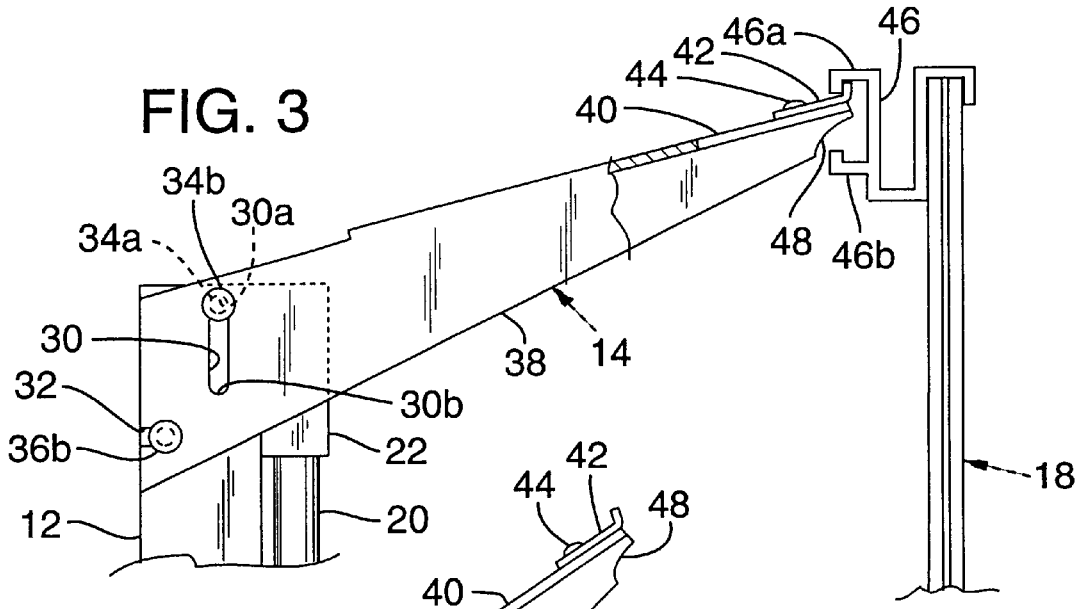
FIG. 3 is a side elevation view of the embodiment of FIG. 1 showing the first locking arm in an open position.

As shown in FIGS. 2 and 3, a cantilevered button 40 is disposed at the distal end of locking arm 14. A first hook 42 is mounted to the cantilevered button 40 by a pair of pins 44. A frame 46 surrounds display 18, and includes an outer lip 46*a* and an inner lip 46*b*. As shown in FIG. 3, when locking arm 14 is in the open position and mounted to display 18, the first hook 42 engages the outer lip 46a of frame 46 of display 18. A radius 48 prevents panel 24 from rubbing against inner lip 46*b* when mounted.

Figure 4:
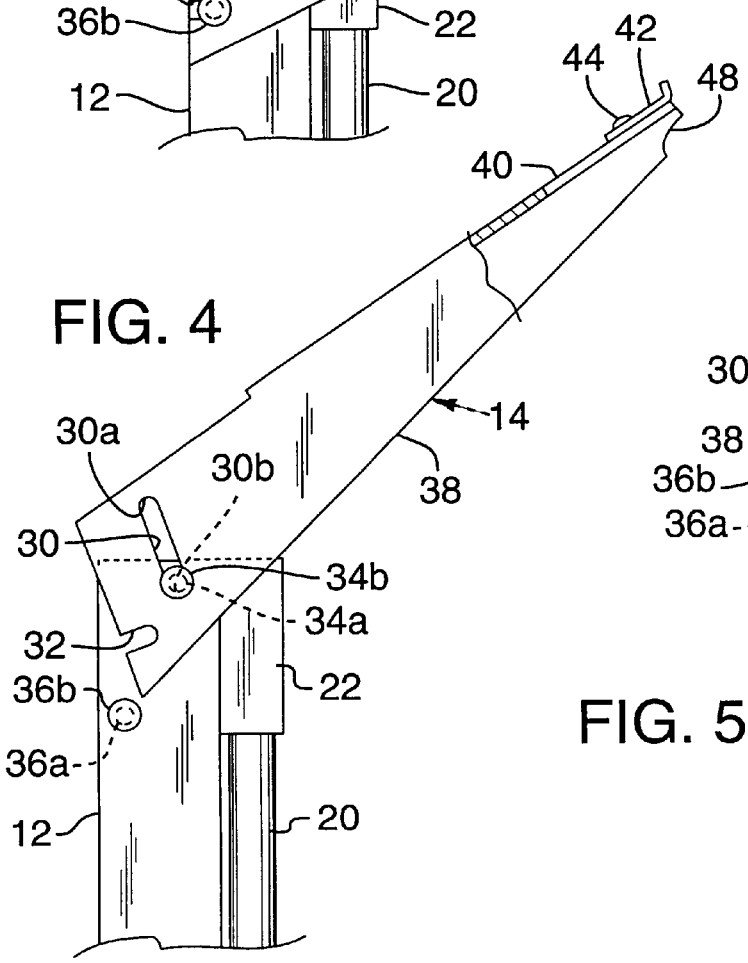
FIG. 4 is a side elevation view of the embodiment of FIG. 1 showing the first locking arm between the open and closed position.
Figure 5:
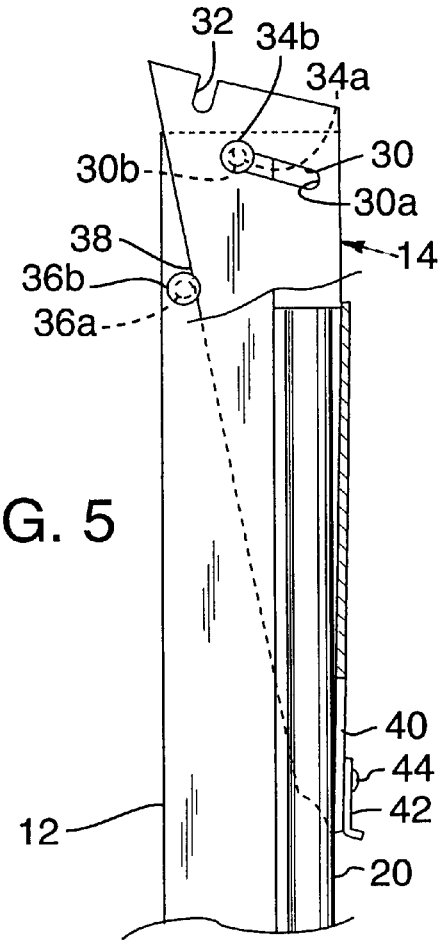
FIG. 5 is a side elevation view of the embodiment of FIG. 1 showing the first locking arm in a closed position.

FIGS. 3–5 show locking arm 14 in an open position (FIG. 3), an intermediate position (FIG. 4), and a closed position (FIG. 5). In the open position, locking arm 14 extends outward from elongate member 12. The first pin 34 rests at a top end 30*a* of slot 30, and the second pin 36 rests in notch 32. In the preferred embodiment: pins 34, 36 screw down (here with an alien wrench—not shown) to further secure locking arm 14 in the open position. To move locking arm 14 from the open position to the closed position, pins 34, 36 are loosened, if necessary and hook 42 is disengaged from outer lip 46*a* by pushing the top of cantilevered button 40. Next, locking arm 14 is rotated counterclockwise relative to elongate member 12, as viewed in FIG. 4, until the second pin 36 is free of notch 32. Locking arm 14 is then slid outward until the first pin 34 comes to rest at a bottom end 30*b* of slot 30. From this position, locking arm 14 is rotated clockwise relative to elongate member 12 until stop 38 of panel 24 comes to rest against the second pin 36, as shown in FIG. 5. Pins 34, 36 screw down with an allen wrench to further secure locking arm 14 in the closed position.

Light bracket 10 is typically used by sales and marketing representatives staffing exhibits at trade shows and conventions. Such a user will often first encounter light bracket 10 in its packaging. The user opens the packaging to find light bracket 10, compact and folded in the closed position, with locking arms 14, 16 protecting lights 20. A section of elongate member 12 between lights 20 affords the user a place to grasp the device to remove it from the box. Removing the device, the user discovers it is lightweight, normally constructed from aluminum and plastic materials. There are no loose parts to become lost or misplaced. No tools are required for assembly. An alien wrench optionally may be used for an extra degree of fastening, as described above.

To open the light bracket and prepare it for mounting to display 18, the user first unscrews pins 34, 36, if necessary, and then rotates and slides locking arms 14, 16 from the closed position to the open position using the procedure described in detail above and shown in FIGS. 3–5.

Once in the open position, the user can mount light bracket 10 to display 18. The user mounts light bracket 10 to display 18 by positioning the hook 42 of the first locking arm 16 on the inside edge of the outer lip 46*a* of frame 46, along the top edge of display 18. Once the first locking arm 14 is engaged, the user can rotate the light bracket 10 while keeping pressure against the top of the frame 46 to engage the hook 40 of the second locking arm 16 with the outer lip 46*a* of frame 46 near the bottom of display 18. Once mounted, the user simply plugs the device into a 110 V electric outlet (not shown) and illuminates the display 18.

The procedure for removal of light bracket 10 is the reverse of installation.

Preferably, locking arms 14, 16 are made of plastic, such as ABS. Preferably elongate member 12 is made of aluminum. Preferably the device is powered by 110V alternating current. Alternatively, other forms of power may be used, including DC batteries and 220 V AC. The light bracket 10 may be mounted in a vertical alignment, as in the preferred embodiment depicted in FIG. 1, or any other orientation, such as a horizontal alignment.

FIGS. 6–9 show an embodiment of light bracket 10 including an elongate member 12 that includes two elongate members 12 coupled together by a coupling unit 50 to form a composite member 52. Coupling unit 50 is symmetrical so that the right side mirrors the left and the top end mirrors the bottom.

Figure 6:
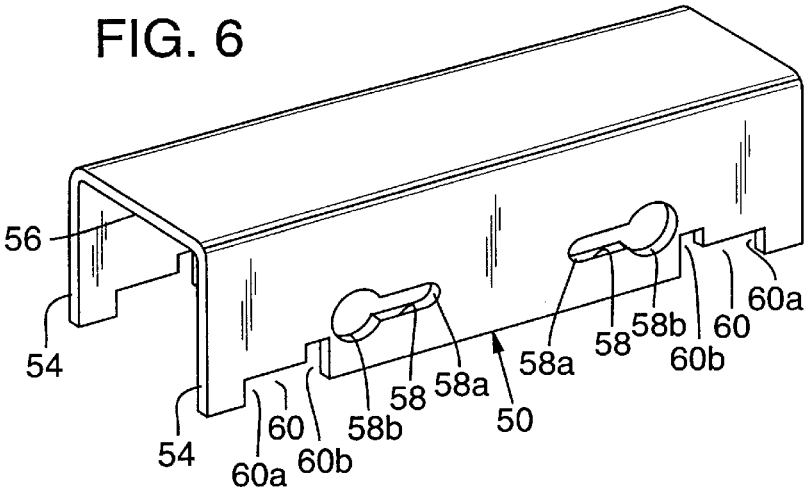
FIG. 6 is a perspective view of a first embodiment of a coupling unit from the top front left.

As shown in FIG. 6, coupling unit 50 includes identical parallel panels 54 linked together by a bridging panel 56. Coupling unit 50 defines a keyhole-shaped internal slot 58 including an elongate channel 58*a* and an oversized hole 58*b* at an outside end of slot 58. Coupling unit 50 also defines an L-shaped notch 60 including an elongate channel 60*a* and a recess 60*b* extending into panel 54 at right angles to elongate channel 60*a* at an inside end of notch 60.

Figure 7:
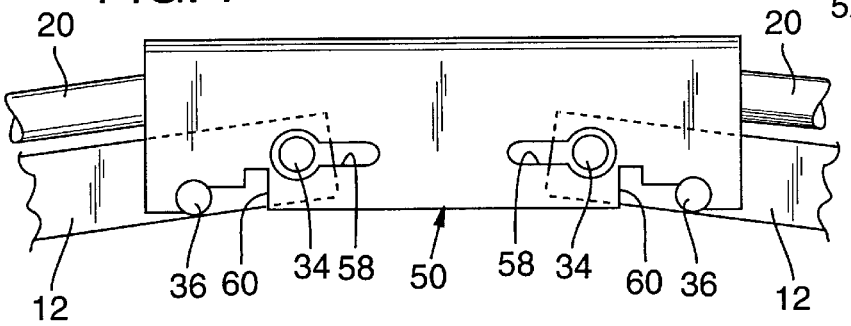
FIG. 7 is a left side detail view of two elongate members partially inserted into the coupling unit of FIG. 6.
Figure 8:
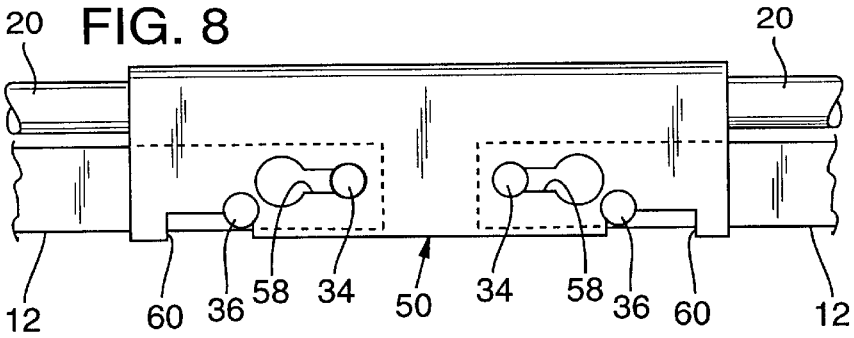
FIG. 8 is a left side detail view of two elongate members fully inserted into the coupling unit of FIG. 6.
Figure 9:
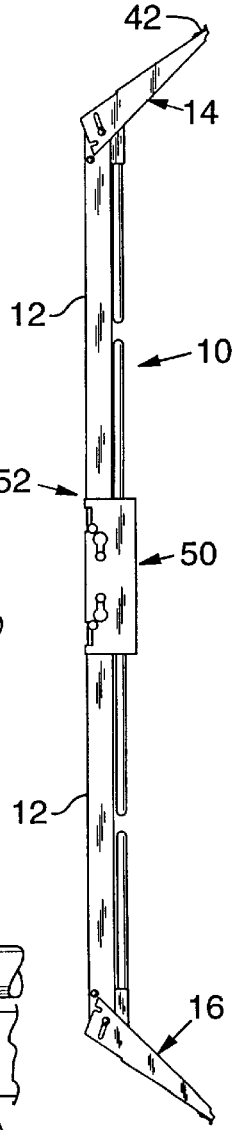
FIG. 9 is a left side view of an embodiment of the present invention including two elongate members linked by the coupling unit of FIG. 6.

Coupling unit 50 mounts between two elongate members 12. To install coupling unit 50, the user positions the coupling unit 50 over an end of elongate member 12, so that the first pin 34 extends through the oversized hole 58*b* in slot 58 and the second pin 36 fits at the outside end of elongate channel 60*a* of notch 60, as shown in FIG. 7. The user next slides coupling unit 50 and elongate member 12 relative to each other so that the first pin 34 slides down slot 58 and comes to a rest at the end of elongate channel 58*a*. From this position, the user can rotate elongate member 12 into coupling unit 50 so that the second pin 36 fits snugly in recess 60*b* of notch 60, as shown in FIG. 8. As shown in FIG. 9, installation of the coupling unit 50 increases the length of the light bracket 10, enabling the user to illuminate larger displays.

The procedure for removal of elongate member 12 from coupling unit 50 is the reverse of installation.

Various changes and modifications can be made to the preferred embodiment without departing from the spirit and scope of the present invention. Those changes and modifications are to be encompassed within the claims that follow.

I claim:

1. A light bracket for mounting and supporting a light adjacent to a surface, comprising:

an elongate member configured to support the light;

a first and a second locking arm, pivotally mounted at opposite ends of the elongate member, each of the arms having an open position extending substantially perpendicular to the elongate member such that each of the arms is configured to mount to the surface and support the elongate member a distance from the surface, and each of the arms being pivotable to a closed position extending substantially parallel to the elongate member such that a space is defined for the light between the first locking arm and the elongate member, and between the second locking arm and the elongate member.

2. The device of claim 1 further comprising a light mounted to the elongate member.

3. The device of claim 2 further comprising a pair of first pins and a respective region in each of the first and second locking arms defining a respective slot, each of the first pins being mounted adjacent an opposite end of the elongate member, and each of the slots being configured to receive the respective first pin such that the corresponding locking arm is rotatably and slidably mounted to the elongate member.

4. The device of claim 3 further comprising a pair of second pins and a respective region in of each of the first and second arms defining a respective notch, each of the second pins being mounted adjacent an opposite end of the elongate member, each notch being configured for removable engagement with a respective second pin when the respective locking arm is pivoted into the open position, the engagement serving to maintain the respective locking arm substantially perpendicular to the elongate member in the open position.

5. The device of claim 4 further comprising a respective region in each of the first and second locking aims defining a respective stop, wherein each of the second pins is configured for removable engagement with the respective stop when the respective locking arm is pivoted into the closed position, the engagement maintaining the second locking arm substantially parallel to the elongate member in the closed position.

6. The device of claim 1 wherein each of the first and second locking arms includes a first panel, a second panel parallel to the first panel, and a bridging panel mounted intermediate the first panel and the second panel, each of the respective first and second panels having a region defining a slot, each respective slot being configured to receive a respective first pin mounted adjacent a respective opposed end of the elongate member such that the respective first and second panels may rotate and slide freely with respect to the elongate member.

7. The device of claim 6 wherein each respective first and second panel further includes a respective region defining a respective notch, each respective notch being configured to engage a respective second pin mounted adjacent a respective opposed end of the elongate member when the corresponding locking arm is pivoted into the open position such that the respective locking arm is maintained in the open position.

8. The device of claim 7 wherein each respective first and second panel further includes a respective stop, each respective stop being configured to engage a respective second pin when the corresponding locking arm is pivoted into the closed position such that the corresponding locking arm is held in the closed position.

9. The device of claim 1 wherein each of the first and second locking arms detach from the elongate member.

10. The light bracket of claim 1, wherein the first locking arm includes:

a cantilevered button extending from a distal end of the first locking arm; and a hook attached to the cantilevered button such that the hook demountably couples to a first side of the surface.

11. The light bracket of claim 10, wherein the second locking arm includes:

a cantilevered button extending from a distal end of the second arm; and a hook attached to the cantilevered button such that the hook demountably couples to a second side of a surface opposite the first side.

12. A light bracket for mounting and supporting a light to illuminate a display comprising:

an elongate member;

a light mounted to the elongate member, the light being configured to illuminate the display;

a first locking arm, rotatably and slidably mounted adjacent a first end of the elongate member by a first pin and slot hinge; the first locking arm having an open position and a closed position, so that rotating and sliding the first locking arm and the elongate member relative to each other causes the first locking arm to move from the closed position to the open position;

a second locking arm, rotatably and slidably mounted adjacent a second end of the elongate member opposite the first end of the elongate member by a second pin and slot hinge; the second locking arm having an open position and a closed position, so that rotating and sliding the second locking arm and the elongate member relative to each other causes the second locking arm to move from the closed position to the open position.

13. The device of claim 12 further comprising a pair of first pins, each of the first pins being mounted adjacent an opposite end of the elongate member, each of the first pins being configured to extend through a respective slot in a respective locking arm and hingedly attach the respective locking arm to the elongate member.

14. The device of claim 13 further comprising a pair of second pins, each of the second pins being mounted adjacent an opposite end of the elongate member, each of the second pins being configured for removable engagement with a respective notch in a respective locking arm when the respective locking arm is pivoted into the open position, the engagement serving to maintain the respective locking arm in the open position.

15. The device of claim 14 wherein each of the second pins is configured for removable engagement with a respective stop in the respective locking arm when the respective locking arm is pivoted into the closed position, the engagement maintaining the second arm in the closed position.

16. The device of claim 12 wherein each of the first and second locking arms includes a first panel, a second panel parallel to the first panel, and a bridging panel mounted intermediate the first panel and the second panel, each of the respective first and second panels having a region defining a slot, each respective slot being configured to receive a respective first pin mounted adjacent a respective opposed end of the elongate member such that the respective first and second panels may rotate and slide freely with respect to the elongate member.

17. The device of claim 16 wherein each respective first and second panel further includes a respective region defining a respective notch, each respective notch being configured to engage a respective second pin mounted adjacent a respective opposed end of the elongate member when the corresponding locking arm is pivoted into the open position such that the respective locking arm is maintained in the open position.

18. The device of claim 17 wherein each respective first and second panel further includes a respective stop, each respective stop being configured to engage a respective second pin when the corresponding locking arm is pivoted into the closed position such that the corresponding locking arm is held in the closed position.

19. The device of claim 12 wherein each of the first and second locking arms detach from the elongate member.

20. The light bracket of claim 12, wherein the first locking arm includes:

a cantilevered button extending from a distal end of the first locking arm; and a hook attached to the cantilevered button such that the hook demountably couples to a first side of the surface.

21. The light bracket of claim 20, wherein the second locking arm includes:

a cantilevered button extending from a distal end of the second arm; and a hook attached to the cantilevered button such that the hook demountably couples to a second side of a surface opposite the first side.

22. A light bracket for mounting and supporting a light to illuminate a display comprising:

a plurality of elongate members;

at least one coupling unit coupling the elongate members end to end to form a composite member;

a first and a second locking arm, mounted at opposite ends of the composite member, each of the arms having an open position extending substantially perpendicular to the composite member such that each of the aims is configured to mount to the surface and support the composite member a distance from the surface, and each of the arms being pivotable to a closed position extending substantially parallel to the composite member such that a space is defined for the light between each of the arms and the composite member.

23. The device of claim 22 further comprising a first light mounted to the composite member, the first light being, configured to illuminate the display.

24. The device of claim 23 further comprising a pair of first pins, each of the first pins being mounted adjacent an opposite end of the composite member, each of the first pins being configured to extend through a respective slot in a respective locking arm and hingedly attach the respective locking arm to the composite member.

25. The device of claim 24 further comprising a pair of second pins, each of the second pins being mounted adjacent an opposite end of the composite member, each of the second pins being configured for removable engagement with a respective notch in a respective locking arm when the respective locking arm is pivoted into the open position, the engagement serving to maintain the respective locking arm in the open position.

26. The device of claim 25 wherein each of the second pins is configured for removable engagement with a respective stop in the respective locking arm when the respective locking arm is pivoted into the closed position, the engagement maintaining the second arm in the closed position.

27. The device of claim 22 wherein each of the first and second locking arms includes a first panel, a second panel parallel to the first panel, and a bridging panel mounted intermediate the first panel and the second panel, each of the respective first and second panels having a region defining a slot, each respective slot being configured to receive a respective first pin mounted adjacent a respective opposed end of the composite member such that the respective first and second panels may rotate and slide freely with respect to the composite member.

28. The device of claim 27 wherein each respective first and second panel further includes a respective region defining a respective notch, each respective notch being configured to engage a respective second pin mounted adjacent a respective opposed end of the composite member when the corresponding locking arm is pivoted into the open position such that the respective locking arm is maintained in the open position.

29. The device of claim 28 wherein each respective first and second panel further includes a respective stop, each respective stop being configured to engage a respective second pin when the corresponding locking arm is pivoted into the closed position such that the corresponding locking arm is held in the closed position.

30. The device of claim 22 wherein each of the first and second locking arms detach from the composite member.

31. The light bracket of claim 22, wherein the first locking arm includes:

a cantilevered button extending from a distal end of the first locking arm; and a hook attached to the cantilevered button such that the hook demountably couples to a first side of the surface.

32. The light bracket of claim 31, wherein the second locking arm includes:

a cantilevered button extending from a distal end of the second arm; and a hook attached to the cantilevered button such that the hook demountably couples to a second side of a surface opposite the first side.

* * * * *